US005131148A

United States Patent [19]

Wahl

[11] Patent Number: 5,131,148

[45] Date of Patent: Jul. 21, 1992

[54] ELECTRIC SHAVER WITH FLEXIBLE CUTTER HOLDER

[75] Inventor: John F. Wahl, Sterling, Ill.

[73] Assignee: Wahl Clipper Corporation, Sterling, Ill.

[21] Appl. No.: 615,168

[22] Filed: Nov. 23, 1990

[51] Int. Cl.[5] ..... B26B 19/02

[52] U.S. Cl. ..... 30/43.92; 30/43.91; 30/346.51

[58] Field of Search ..... 30/43.92, 43.9, 44, 30/346.51, 42, 43.3, 43, 43.91

[56] References Cited

U.S. PATENT DOCUMENTS

| | | | |
|---|---|---|---|
| 2,908,074 | 10/1959 | Kleinman | 30/41 |
| 3,376,636 | 4/1968 | Schuessler | 30/34.1 |
| 3,386,167 | 6/1968 | Schuessler | 30/34.1 |
| 3,423,826 | 1/1969 | Liska | 30/43.92 |
| 3,456,341 | 7/1969 | Loner et al. | 30/43.92 |
| 3,579,824 | 5/1971 | Matsumoto | 30/346.51 |
| 3,810,306 | 5/1974 | Locke | 30/346.51 |
| 3,997,969 | 12/1976 | Czerner et al. | 30/43.92 |
| 4,001,933 | 1/1977 | Czerner | 30/43.92 |
| 4,089,109 | 5/1978 | Czerner et al. | 30/34.1 |
| 4,219,930 | 9/1980 | Franko et al. | 30/43.92 |
| 4,312,126 | 1/1982 | Rochelt | 30/43.92 |
| 4,428,117 | 1/1984 | Horii et al. | 30/43.9 |
| 4,649,642 | 3/1987 | Nagasaki et al. | 30/34.1 |
| 4,796,359 | 1/1989 | Oprach et al. | 30/43.92 |
| 4,797,997 | 1/1989 | Packham et al. | 30/43.92 |

OTHER PUBLICATIONS

Braun Model 5585 Shaver (photos attached).

*Primary Examiner*—Frank T. Yost
*Assistant Examiner*—Hwei-Siu Payer
*Attorney, Agent, or Firm*—Emrich & Dithmar

[57] ABSTRACT

The dry electric shaver includes a pair of movable cutter blocks reciprocatively movable by a drive bar with respect to a fixed perforated comb. The cutter blocks are coupled to the drive bar by a unitary one-piece plastic cutter support having a central body engageable with the drive bar and having coaxial torsion bars extending from the opposite sides thereof, the distal ends of the torsion bars being respectively integral with the midpoints of elongated arms disposed substantially perpendicular to the torsion bars. Each arm carries at each of its ends an attachment portion having an opening receiving a stake on the cutter block in press-fitted engagement. The cutter support is sufficiently resilient and flexible to accommodate varied movements of the cutter blocks independently of each other, while remaining relatively stiff in the direction of movement of the drive bar. A bias spring urges the cutter support and the supported cutter blocks toward shearing engagement with the comb.

20 Claims, 1 Drawing Sheet

Fig 1
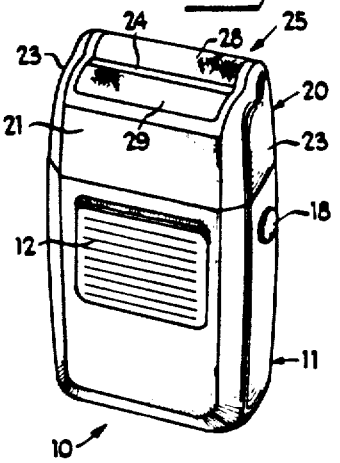
Fig 4
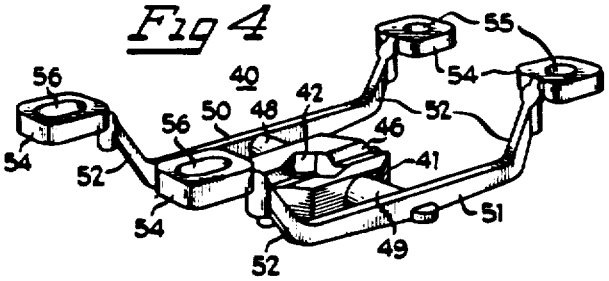
Fig 5
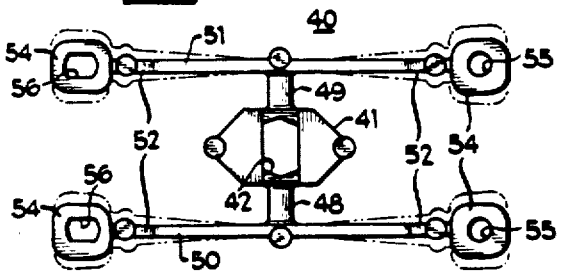
Fig 2
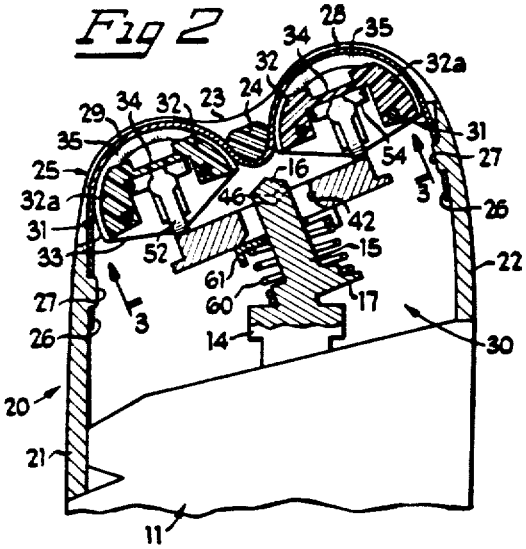
Fig 6
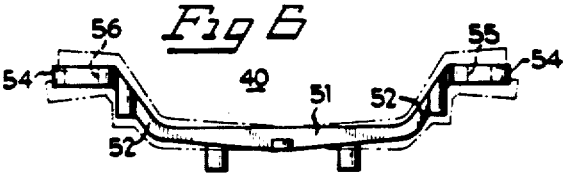
Fig 3
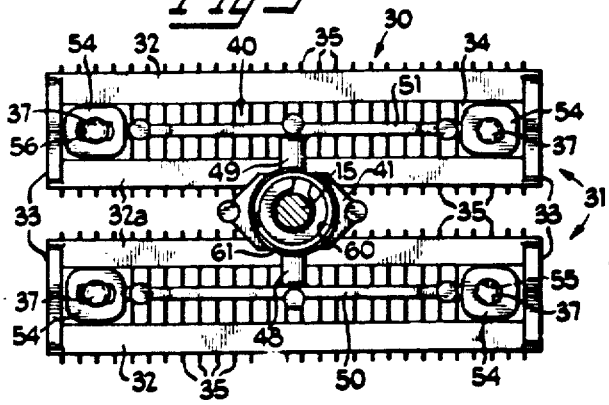
Fig 7
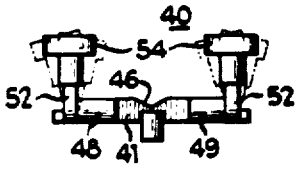
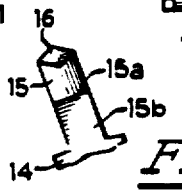
Fig 8

ELECTRIC SHAVER WITH FLEXIBLE CUTTER HOLDER

BACKGROUND OF THE INVENTION

1. Field of the Invention

The present invention relates to electric dry shavers of the type having a pair of movable cutters driven by an oscillating drive arm in shearing relationship with a fixed cutter in the form of a thin metallic foil comb, the movable cutters being biased into shearing engagement with the inner surface of the comb. The invention relates in particular to means for supporting, driving and power cleaning the movable cutters.

2. Description of the Prior Art

In electric dry shavers it is typical to provide one or more elongated cutter blocks, each carrying a plurality of part-circular cutter blades, which are resiliently biased toward shearing engagement with the inner surface of a fixed cutter in the form of a perforated comb formed of a thin metallic foil. The cutter blocks are reciprocatively driven in shearing relationship with the comb by an oscillating electric motor-driven drive arm.

Various means are provided for coupling the drive arm to the cutter blocks. A common technique is to mount the cutter blocks on one or more rigid drive blocks, which are, in turn, coupled to the drive arm. This provides an accurate transmission of the driving motion of the drive arm to the cutter blocks, but it does not permit any variation in the positions and movement of the cutter blocks. This can be troublesome, since it is not uncommon for there to be small shape or position discrepancies, or for there to be slight deflections of the comb in response to engagement with the face of the user in operation. Such discrepancies reduce the shaving efficiency and deformations or deflections can cause interference between the comb and the moving cutter blocks, resulting in poor cutting, or even damage to the comb.

At least one prior shaver has addressed this problem by providing a type of universal mounting for the cutter blocks which permits slight pivotal movements of the cutter blocks about mutually perpendicular pivot axes, so that the cutter blocks can automatically adjust their positions to follow the shape of the comb in use. However, this prior arrangement is a complicated multi-part construction utilizing multiple swivel joints.

It is also known to provide a dual-head shaver with mounting of the comb heads on a pair of unitary molded support frames having resiliently hinged portions which accommodate relative movement of the heads in use. But in this shaver, disclosed, e.g., in U.S. Pat. No. 4,797,997, the movable cutters are supported by a complicated, multi-part construction which has only vertical flexibility.

SUMMARY OF THE INVENTION

It is a general object of the invention to provide an improved support for the movable cutters of an electric dry shaver which avoids the disadvantages of prior constructions while affording additional structural and operating advantages.

An important feature of the invention is the provision of a cutter support for an electric dry shaver which is of relatively simple and economical construction.

Another feature of the invention is to provide a cutter support which is of very light weight and which contributes only a small amount to the moving cutter mass.

Still another feature of the invention is the provision of a cutter support of the type set forth, which will permit the movable cutters to self-adjust their positions to accommodate misalignment and deflections in an associated fixed cutter.

Still another feature of the invention is the provision of a flexible and resilient movable cutter support which tends to amplify the driven movements of the movable cutters when the shaver is operated with the fixed cutter removed to facilitate self-cleaning of the movable cutters.

In connection with the foregoing feature, it is another feature of the invention to provide a movable cutter support of the type set forth which affords a wide variety of types of movements of the cutter, while providing a relatively stiff coupling to the movable cutter in the direction of movement of the drive means.

In connection with the foregoing feature, yet another feature of the invention is the provision of a cutter support of the type set forth which accommodates a certain amount of non-translational movement of the movable cutters while shaving.

These and other features of the invention are attained by providing in a shaver including drive means for operating a movable cutter in shearing relationship with a fixed cutter, the improvement comprising: a unitary one-piece cutter support including mounting means fixed to the movable cutter and coupling means engageable with the drive means and responsive to movement of the drive means for moving the cutter support and the movable cutter, the cutter support further including flexible and resilient means interconnecting the mounting means and the coupling means for providing accurate alignment between the movable cutter and the fixed cutter.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 1 is a front perspective view of an electric dry shaver incorporating the features of the present invention;

FIG. 2 is an enlarged fragmentary view in vertical section of the cutter heads of the shaver of FIG. 1;

FIG. 3 is a sectional view taken along the line 3—3 in FIG. 2 and illustrating the cutter head assembly;

FIG. 4 is a perspective view of the cutter support of the shaver of FIG. 2, constructed in accordance with the features of the present invention with the cutter blocks removed;

FIG. 5 is a bottom plan view of the cutter support of FIG. 4, illustrating in broken line a first range of movement thereof;

FIG. 6 is a side elevational view of the cutter support of FIG. 4, illustrating in broken line a second range of movement thereof;

FIG. 7 is an end elevational view of the cutter support of FIG. 4, illustrating in broken line a third range of movement thereof, and FIG. 8 is a fragmentary elevational view of an alternative drive arm construction.

DESCRIPTION OF THE PREFERRED EMBODIMENT

Referring to FIGS. 1 and 2, there is illustrated an electric dry shaver generally designated by the numeral 10, having a main casing 11 in which is housed an electric motor (not shown). A slide actuator 12 is provided on the front wall of the casing 11 for actuating an associated switch (not shown) to control the operation of the motor in a known manner. The output of the motor is connected to a coupling block 14 from which extends an upstanding drive arm 15, inclined at a predetermined angle to the axis of the coupling block 14. The drive arm 15 is provided at its distal end with an enlarged head 16 which is generally rectangular in outline, with its long axis disposed substantially perpendicular to the axis of the drive arm 15, and which is substantially diamond-shaped in transverse cross-section. A tab 17 extends from the base of the drive arm 15 substantially perpendicular thereto. In use, the motor effects an oscillatory reciprocating movement of the coupling block 14 and the drive arm 15 in directions into and out of the paper, as viewed in FIG. 2, all in a known manner. It will be appreciated that the motor could be AC or battery-powered. Also, while an electric shaver is disclosed, the principles of the present invention would apply equally well to a mechanically powered shaver, such as a wind-up shaver.

Mounted on a side wall of the casing 11 is a push button 18 for actuating a latch (not shown) engageable with keeper structure (not shown) on the inside of a cover 20 which fits over the upper end of the casing 11. The cover 20 has a front wall 21, a rear wall 22 and a pair of opposed side walls 23, all formed in a unitary, one-piece construction which is open at the top and bottom thereof. A rod 24 extends between the side walls 23 at the upper ends thereof, substantially midway between the front and rear walls 21 and 22.

A perforated comb or screen 25, formed of a metallic foil, is mounted on the cover 20 and closes the upper end thereof. More specifically, the comb 25 has margins 26 along the front and rear edges thereof which respectively extend downwardly along the inner surfaces of the front and rear walls 21 and 22 of the cover 20. The margins 26 have openings therein which respectively receive lugs 27 projecting inwardly from the front and rear walls 21 and 22 for fixedly securing the comb 25 in place. The comb 25 extends beneath the rod 24 and is so dimensioned as to provide two preformed bowed portions 28 and 29, respectively disposed on opposite sides of the rod 24 and resiliently projecting upwardly thereabove to form two fixed cutters. It will be appreciated that, in use, the hairs to be cut extend through the perforations in the comb 25 for shearing by a cutter head assembly 30 mounted therebeneath.

Referring also to FIG. 3, the cutter head assembly 30 includes two movable cutter blocks 31 substantially identical in construction. Each of the cutter blocks 31 is an elongated, generally rectangular structure including a pair of laterally spaced-apart side rails 32 and 32*a* interconnected at the ends thereof by flat end walls 33. The upper edges of the rails 32 and 32*a* are also interconnected by webs 34 at the opposite ends thereof and midway between the ends thereof. Each cutter block 31 carries a plurality of generally semi-annular cutter blades 35, equidistantly spaced-apart longitudinally of the cutter block 31 and projecting a predetermined distance upwardly therefrom. Preferably, each of the cutter blocks 31 is of molded, one-piece construction and the cutter blades 35 are embedded therein. Respectively depending from each of the end ones of the webs 34 are fastening lugs or stakes 37.

Referring now also to FIGS. 4–7, the cutter head assembly 30 also includes a cutter support 40, which is of unitary, one-piece construction, and may be formed by molding of a suitable material, such as a suitable plastic. The cutter support 40 includes a central drive block 41 having a generally rectangular aperture 42 formed therethrough which is very slightly larger in size than the drive arm head 16. Formed in the upper surface of the drive block 41 centrally thereof is a V-shaped groove 46 which extends the length of the drive block 41 perpendicular to the long axis of the rectangular aperture 42. This V-shaped groove is dimensioned to mate with the head 16 of the drive arm 15, as will be explained more fully below.

Respectively extending laterally outwardly from the opposite sides of the drive block 41 centrally thereof are two substantially cylindrical and coaxial support projections in the form of torsion bars 48 and 49, the axis of which extends longitudinally through the center of the aperture 42. The torsion bars 48 and 49 are respectively integral at their distal ends with the midpoints of two parallel, elongated arms 50 and 51 which are perpendicular to the axis of the torsion bars 48 and 49 and parallel to the V-shaped groove 46. Each of the arms 50 and 51 is integral at its opposite ends with inclined upstanding end portions 52, each of which is, in turn, integral at its distal end with a generally flat rectangular mounting plate 54. The mounting plates 54 are all substantially coplanar and spaced a predetermined distance above and parallel to an imaginary plane which passes though the drive block 41, the torsion bars 48 and 49 and the arms 50 and 51. Each of the mounting plates 54 at one end of the cutter support 40 has a round hole 55 formed therethrough, while each of the mounting plates 54 at the other end of the cutter support 40 has an oblong hole 56 formed therethrough. Preferably, the cutter support 40 is bilaterally symmetrical with respect to a medial plane extending through the apex of the V-shaped groove 46 perpendicular to the axis of the torsion bars 48 and 49.

In use, each of the arms 50 and 51 supports one of the cutter blocks 31. More specifically, each of the arms 50 and 51 is so dimensioned that the mounting plates 54 thereof are respectively engageable with the bottom surfaces of the webs 34 of the associated cutter block 31, with the fastening stakes 37 being respectively received through the holes 55 and 56 in press-fitted engagement. The length of the oblong holes 56 will accommodate normal variations in dimensions of the parts when positioning the mounting plates 54 on the fastening stakes 37. This serves to avoid any bending stress in the cutter blocks 31. The ends of the stakes 37 may be flattened, once inserted through the holes 55 and 56 to prevent removal therefrom.

When the cutter blocks 31 are mounted in place on the cutter support 40, as illustrated in FIG. 3, and the cutter head assembly 30 is at rest, the cutter blocks 31 will be disposed substantially parallel to each other. However, it is a significant aspect of the present invention that the material, shape and dimensions of the cutter support 40 are such that it has substantial flexibility and resilience so as to accommodate imperfect alignment of the cutter blocks 31 with the comb 25 and permit a certain amount of non-translational movement of the cutter blocks 31 mounted thereon, independently of each other.

More specifically, each cutter block 31 can undergo several different pivotal ranges of motion. For example, each of the arms 50 and 51 has a small degree of flex, allowing some pivotal movement about an axis extending through its midpoint substantially perpendicular to the axis of the torsion bars 48 and 49, as illustrated by the broken lines in FIG. 5. Also, each of the arms 50 and 51 is pivotally movable about the axis of the torsion bars 48 and 49 by torsional movement of those bars, as illustrated by the broken lines in FIG. 6. Finally, the arms 50 and 51 can undergo a slight pivotal movement, as indicated by the broken lines in FIG. 7. It will be appreciated that each of the cutter blocks 31 can undergo movements simultaneously incorporating components of each of these different ranges of movement.

The cutter head assembly 30 also includes a helical compression spring 60 which is adapted to fit coaxially around the drive arm 15, the spring 60 being trapped between the tab 17 and an annular split-ring retainer 61 which encircles the drive arm 15 and is held in place by the head 16. In use, the cutter head assembly 30 is mounted in place on the casing 11 by fitting the compression spring 60 telescopically down over the drive arm 15, and then mounting the retainer 61 in place on the drive arm 15 between the spring 60 and the head 16. In order to mount the cutter support 40 it is oriented so that the head 16 of the drive arm 15 will be received through the aperture 42, with the drive block 41 bearing against the retainer 61 to compress the spring 60. When the head 16 has passed completely through the aperture 42, the cutter head assembly 30 is rotated through about 90° so that the longitudinal axes of the head 16 and the aperture 42 are substantially perpendicular to each other, and the head 16 is allowed to seat in the mating V-shaped groove 46, thereby retaining the cutter head assembly 30 in place on the drive arm 15. It will be appreciated that the orientation of the drive arm 15 is such that when the cutter head assembly 30 is mounted in place, the longitudinal axes of the cutter blocks 31 will extend substantially parallel to the direction of movement of the drive arm 15, as illustrated in FIG. 2. It will be further appreciated that, in this mounted configuration, the compression spring 60 resiliently urges the cutter support 40 upwardly, holding the drive block 41 firmly in alignment and against the head 16 of the drive arm 15.

The cover 20 is then mounted in place over the cutter head assembly 30, with the cutter blocks 31 being respectively received beneath the bowed portions 28 and 29 of the comb 25, as illustrated in FIG. 2. This will compress the spring 60 slightly moving the drive block 41 down so as to disengage the head 16 from the V-shaped groove 46. Thus, the compression spring 60 serves to resiliently urge the cutter head assembly 30 upwardly in a direction toward shearing engagement of the cutter blades 35 with the inner surface of the comb 25. When the motor is operated, the cutter blocks 31 are oscillated back and forth beneath the comb 25 in shearing relationship therewith for shearing hairs extending through the perforations in the comb 25, all in a known manner. It is important to point out that when the fastening stakes 37 are attached to the mounting plates 54, the resultant assembly, while flexible laterally and transversely, becomes a relatively stiff cutter block coupling in the direction of movement of the drive arm 15 for driving the cutter blocks 31 back and forth in high-speed shearing engagement with the comb 25. It will be appreciated that the resilience and flexibility of the cutter support 40 provide perfect alignment between imperfect cutter and comb parts, and also accommodate non-translational movements of the cutter blocks 31 in operation, so that their positions can readily be adapted to any deflections or deformations of the comb 25 in use without damage to the comb 25 or to the cutter blocks 31.

In normal shaving operations, when the comb 25 is in place it will serve to constrain the movements of the cutter blocks 31 substantially to the directions of movement of the drive bar 15. However, when the comb 25 is removed, the cutter blocks 31 will be free to move in other directions permitted by the flexibility and resilience of the cutter support 40. Thus, when the shaver 10 is operated with the comb 25 removed, the cutter blocks 31 will tend to undergo a random oscillatory movement in various directions, resulting in a vibratory action which shakes shaving debris from between the cutter blades 35, thereby providing an effective self-cleaning action.

Referring to FIG. 8, there is illustrated an alternative construction of the drive arm 15. In this embodiment, the drive arm 15 has the same circular cross section as in FIG. 2, down to a transition line **15*a*, at which point it assumes a substantially rectangular transverse cross section for the lower portion 15*b*. The transition line 15*a* is so positioned that, when the cutter head assembly 30 is in the position illustrated in FIG. 2, the transition line 15*a* will be disposed a slight distance into the lower end of the aperture 42. The dimensions of the substantially rectangular portion 15*b* of the drive arm 15 are such that it extends across the entire width of the aperture 42, thereby effectively preventing any rotational movement of the cutter support 40 about the axis of the drive arm 14. This is significant since, in certain shaving conditions, the shaving action might tend to exert on the cutter head assembly 30 a force which would tend to pivot it and move it out of proper alignment with the comb 35. The drive arm construction of FIG. 8** effectively prevents such pivotal action, in use.

From the foregoing, it can be seen that there has been provided an improved support for the movable cutters of a dry electric shaver which simply and economically provides great flexibility of motion of the movable cutters so as to permit them to readily adapt to the free dimensions of the comb and deflections or deformations in the comb in operation and to permit self-cleaning of the movable cutter when the comb is removed.

I claim:

1. In a shaver including drive means for operating a movable cutter in shearing relationship with a fixed cutter, the improvement comprising: a unitary one-piece cutter support including mounting means fixed to the movable cutter and coupling means engageable with the drive means and responsive to movement of the drive means for moving said cutter support and the movable cutter in a predetermined direction, said cutter support further including flexible and resilient means interconnecting said mounting means and said coupling means for providing accurate alignment between the movable cutter and the fixed cutter, said flexible and resilient means including first means pivotally movable about a first axis and second means coupled to said first means for movement therewith and pivotally movable about a second axis, said first and second axes being substantially perpendicular to each other and to the predetermined direction of movement of the movable cutter.

2. The shaver of claim 1, wherein said cutter support is formed of plastic.

3. The shaver of claim 1, wherein the movable cutter includes a relatively rigid frame extending in the direction of movement of the drive means.

4. The shaver of claim 3, wherein said mounting means includes an aperture formed in said cutter support, and means on the movable cutter adapted for frictional press-fitted engagement in said aperture.

5. The shaver of claim 1, wherein said mounting means includes means for securing said cutter support to the movable cutter at a plurality of locations thereon.

6. The shaver of claim 1, wherein said flexible and resilient means includes means pivotally movable about a third axis which is disposed substantially parallel to the predetermined direction of movement of the movable cutter.

7. In a shaver including drive means for operating a plurality of movable cutters in shearing relationship with fixed cutters, the improvement comprising: a unitary one-piece cutter support including mounting means fixed to all of the movable cutters and coupling means engageable with the drive means and responsive to movement of the drive means for moving said cutter support and the movable cutters in a predetermined direction, said cutter support further including flexible and resilient means interconnecting said mounting means and said coupling means for providing accurate alignment between the movable cutters and the fixed cutters, said flexible and resilient means including first means pivotally movable about a first axis and second means coupled to said first means for movement therewith and pivotally movable about a second axis, said first and second axes being substantially perpendicular to each other and to the predetermined direction of movement of the movable cutters.

8. The shaver of claim 7, wherein the number of movable cutters is two.

9. The shaver of claim 8, wherein said coupling means includes a central body engageable with the drive means, said flexible and resilient means including support means carried by said central body at opposite sides thereof for respectively supporting the movable cutters.

10. The shaver of claim 7, wherein said flexible and resilient means includes means accommodating movement of the movable cutters independently of one another.

11. The shaver of claim 7, and further comprising bias means resiliently urging said cutter support toward shearing engagement of the supported movable cutters with the fixed cutters.

12. The shaver of claim 7, wherein said flexible and resilient means includes means pivotally movable about a third axis which is disposed substantially parallel to the predetermined direction of movement of the movable cutters.

13. In a shaver including drive means for operating a pair of movable cutters in shearing relationship with fixed cutters, the improvement comprising: a unitary one-piece cutter support, said cutter support including a body engageable with the drive means for movement thereby, two torsion bars extending from said body and each having a longitudinal axis, two elongated arms respectively integral with said torsion bars at the distal ends thereof, each of said arms having spaced-apart mounting portions for attachment to a corresponding one of the movable cutters at spaced-apart locations thereon, each of said torsion bars being torsionally movable with respect to its associated axis to accommodate pivotal movement of the corresponding arm with respect to said axis, and each of said arms being movable with respect to said body substantially parallel to a plane which is parallel to the axis of the corresponding torsion bar.

14. The shaver of claim 13, wherein said torsion bars are coaxial.

15. The shaver of claim 14, wherein the axis of said torsion bars is disposed substantially perpendicular to the direction of movement of the drive means.

16. The shaver of claim 13, wherein each of said torsion bars is integral with its corresponding arm intermediate the ends thereof.

17. The shaver of claim 16, wherein said mounting portions of each of said arms are respectively disposed at the opposite ends thereof.

18. The shaver of claim 17, wherein each of said mounting portions includes an opening formed in said arm, and further comprising projections on the associated movable cutter respectively adapted for press-fit engagement in said openings.

19. The shaver of claim 13, wherein each of said arms includes an elongated central portion integral with the corresponding torsion bar, and a pair of upstanding end portions integral with said central portion at the opposite ends thereof and inclined with respect thereto, said mounting portions being respectively carried by said end portions at the distal ends thereof.

20. The shaver of claim 13, wherein the drive means has a drive axis and includes means cooperating with said cutter support to inhibit rotational movement thereof about the drive axis.

* * * * *